US005890655A

United States Patent [19]

Collias et al.

[11] Patent Number: 5,890,655

[45] **Date of Patent: *Apr. 6, 1999**

[54] FAN SPRAY NOZZLES HAVING ELASTOMERIC DOME-SHAPED TIPS

[75] Inventors: Dimitris I. Collias; Stephan G. Bush, both of Cincinnati; Robert E. Stahley, Middletown, all of Ohio

[73] Assignee: The Procter & Gamble Company, Cincinnati, Ohio

[ * ] Notice: The term of this patent shall not extend beyond the expiration date of Pat. No. 5,642,860.

[21] Appl. No.: 781,998

[22] Filed: Jan. 6, 1997

[51] Int. Cl.[6] ..... B05B 15/02

[52] U.S. Cl. ..... 239/107; 239/333; 239/526; 239/597

[58] Field of Search ..... 239/333, 597, 239/533.13, 602, 106, 107, 526, 588, 527; 223/383.1

[56] References Cited

U.S. PATENT DOCUMENTS

| | | | |
|---|---|---|---|
| D. 198,356 | 6/1964 | Wahlin | D91/1 |
| D. 226,712 | 4/1973 | Tada | D23/17 |
| 1,636,314 | 7/1927 | Murray . | |
| 1,702,508 | 2/1929 | Herrmann | 239/602 X |
| 2,296,715 | 9/1942 | Komar | 299/154 |
| 2,308,476 | 1/1943 | Gerrer | 299/59 |
| 2,373,555 | 4/1945 | Folke | 299/133 |
| 2,621,078 | 12/1952 | Wahlin | 299/154 |
| 2,767,023 | 10/1956 | Venus, Jr. | 299/114 |
| 3,199,787 | 8/1965 | Oishei | 239/533.13 X |
| 3,214,102 | 10/1965 | Meyer | 239/602 X |
| 3,346,195 | 10/1967 | Groth | 239/337 |
| 3,419,189 | 12/1968 | Iketani | 222/54 |
| 3,428,223 | 2/1969 | Lewiecki et al. | 222/398 |
| 3,647,147 | 3/1972 | Cook | 239/599 |
| 3,692,243 | 9/1972 | Breunsbach | 239/401 |
| 3,701,478 | 10/1972 | Todd | 239/333 |
| 3,899,135 | 8/1975 | O'Brian | 239/534 |

(List continued on next page.)

FOREIGN PATENT DOCUMENTS

| | | | |
|---|---|---|---|
| 0 466 157 A2 | 1/1992 | European Pat. Off. | B05B 11/00 |
| 2689864 A1 | 10/1993 | France | B65D 47/44 |
| 2440909 A1 | 4/1975 | Germany | B05B 1/02 |
| 447970 | 3/1965 | Switzerland | 239/333 |
| 341580 | 7/1972 | U.S.S.R. | B22C 23/02 |
| 1729602 | 4/1992 | U.S.S.R. | 239/533.13 |
| 1729602 A1 | 4/1992 | U.S.S.R. | B05B 1/04 |
| WO 83/00134 | 1/1983 | WIPO | B65D 83/14 |
| WO 90/14893 | 12/1990 | WIPO | B05B 1/02 |
| WO 93/21081 A1 | 10/1993 | WIPO | B65D 47/20 |

OTHER PUBLICATIONS

*Elastomer Technology Handbook* by Nicholas P. Cheremisinoff, Ph.D., Chapter 14 "Thermoplastic Elastomers: A Rising Star" (M.T. Payne & C.P. Rader)(1993).

Atomization and Sprays by A. H. Lefebvre (pp. 6, 10, 61, 125–127) (1989).

Continental Sprayers, Inc. – 922 Ajust–O–Spray (pamphlet).

Black Liquor Mechanisms of liquid sheet breakup and the resulting drop size distributions (pp. 136–142) by T. M. Spielbauer and C. K. Aidun (Feb. 1992 Tappi Journal).

Engineers Digest, vol. 27, No. 5, May 1966, p. 9 XP002059209.

U.S. applicaton No. 08/499,753, Bush, filed Jul. 7, 1995.

U.S. application No. 08/625,833, Bush et al., filed Apr. 1, 1996.

*Primary Examiner*—Kevin Weldon

*Attorney, Agent, or Firm*—Rodney M. Young

[57] ABSTRACT

A nozzle for dispensing fluids with suspended solid particulates without experiencing permanent partial or total clogging is provided. The nozzle is made from a elastomeric material and has a dome-shaped tip. The dome-shaped tip has a slit that provides an elongated orifice which generates a fan-type spray pattern while allowing solid particulates to pass through the nozzle without permanent clogging. The slit is normally maintained closed at rest and provides precompression and shut-off functions. Several versions of the nozzle are described, such as a one-piece nozzle and a nozzle insert. Additionally, the nozzle can be attached to a manually actuated pump device and be used as a spray delivery system.

13 Claims, 6 Drawing Sheets

U.S. PATENT DOCUMENTS

| | | | |
|---|---|---|---|
| 3,930,619 | 1/1976 | Levey et al. | 239/526 |
| 4,007,465 | 2/1977 | Chaudhary | 346/140 |
| 4,109,869 | 8/1978 | Brockelsby et al. | 239/491 |
| 4,142,003 | 2/1979 | Sejpal | 426/601 |
| 4,154,379 | 5/1979 | Schermutzki | 222/420 |
| 4,155,770 | 5/1979 | Doumani | 106/267 |
| 4,156,398 | 5/1979 | McDaniel | 118/2 |
| 4,161,288 | 7/1979 | McKinney | 239/333 |
| 4,168,788 | 9/1979 | Quinn | 239/333 X |
| 4,174,069 | 11/1979 | Grogan | 239/333 |
| 4,227,650 | 10/1980 | McKinney | 239/333 |
| 4,252,507 | 2/1981 | Knickerbocker | 417/444 |
| 4,253,611 | 3/1981 | Hart | 239/602 |
| 4,256,526 | 3/1981 | McDaniel | 156/295 |
| 4,269,355 | 5/1981 | Geberth, Jr. | 239/107 |
| 4,346,849 | 8/1982 | Rood | 239/597 |
| 4,384,008 | 5/1983 | Millisor | 426/613 |
| 4,454,988 | 6/1984 | Waldrum | 239/118 |
| 4,611,761 | 9/1986 | Pollard | 239/284 |
| 4,618,101 | 10/1986 | Piggott | 239/589 |
| 4,747,523 | 5/1988 | Dobbs | 222/383 |
| 4,880,530 | 11/1989 | Frey | 209/380 |
| 4,893,754 | 1/1990 | Ruiz | 239/601 |
| 5,004,123 | 4/1991 | Stoody | 222/94 |
| 5,033,676 | 7/1991 | King et al. | 239/107 |
| 5,115,978 | 5/1992 | King et al. | 239/107 |
| 5,133,502 | 7/1992 | Bendig et al. | 239/504 |
| 5,197,637 | 3/1993 | Naumann | 222/207 |
| 5,215,254 | 6/1993 | Haruch | 239/107 |
| 5,249,747 | 10/1993 | Hanson et al. | 239/373 |
| 5,271,566 | 12/1993 | Dederich | 239/600 |
| 5,284,132 | 2/1994 | Geier | 128/200 |
| 5,323,963 | 6/1994 | Ballu | 239/63 |
| 5,370,317 | 12/1994 | Weston | 239/533.14 |
| 5,370,318 | 12/1994 | Weston | 239/533.14 |
| 5,472,122 | 12/1995 | Appleby | 222/212 |
| 5,518,377 | 5/1996 | Bougamont et al. | 417/446 |
| 5,531,363 | 7/1996 | Gross et al. | 222/494 |
| 5,642,860 | 7/1997 | Bush et al. | 239/602 X |

FAN SPRAY NOZZLES HAVING ELASTOMERIC DOME-SHAPED TIPS

FIELD OF THE INVENTION

The present invention relates to nozzles for dispensing fluid products in a fan spray pattern. In particular, nozzles that atomize difficult to spray (e.g. solids laden) fluids.

BACKGROUND OF THE INVENTION

It has been the objective of many fluid dispensing systems to deliver fluid products in the form of a spray. Such a delivery system is one of the most effective in terms of producing a relatively uniform coating of fluid on a target surface. When a consumer product can be applied in an atomized spray form, the consumer can perceive tangible benefits such as reduced usage of product, reduced messiness in the application of the product, and less opportunity for contamination. Manually actuated, hand holdable, pump spray delivery systems are convenient for household consumers to use and are preferred by such users since they can be held with one hand while the atomized spray is directed toward the target surface. Thus, the development of such spray delivery systems having a nozzle which can deliver a wide range of products, such as hair sprays, cosmetics, vegetable oils, and the like, in an atomized spray has significant commercial value.

A common problem with pump spray delivery systems is that solid particles individually or in agglomerated groups can cause clogging of the small passages in the nozzles. It is therefore desirable to have a nozzle capable of clearing the clog itself. Such a nozzle could contain a separate cleaning mechanism, but such mechanisms typically require some separate action on the part of the user or the incorporation of extra parts. Ideally, it is desirable that a nozzle be designed wherein at the onset of clogging, the nozzle initiates a self cleaning action.

Another problem associated with many pump spray delivery systems is startup and shutoff of the fluid product spray during the beginning and end of an actuation cycle. When hydraulic pressure and flow rate are building up or tapering off, most nozzles tend to poorly disperse the product or tend to eject the product in a slow moving concentrated stream. This results in messiness and product waste, as well as being inconvenient to the user. One way to solve this problem is by utilizing a nozzle which is normally maintained closed and that requires a minimum hydraulic pressure in order to open. Such a precompression function not only provides the additional benefit of preventing product flow prematurely through the nozzle, but can also avoid inadvertent dispensing due to differential pressures between the inside and outside of the container. Such a nozzle can thus serve as a shipping seal. Unfortunately, a normally closed nozzle can also prevent or inhibit priming of the pump. Therefore, a nozzle that provides a balance between shutoff and priming can be very beneficial by providing enhanced reliability as well as improved performance.

Some liquid dispensing nozzles designed for industrial use have attempted to resolve some of the aforementioned problems by utilizing a deformable outlet to achieve the goal of self cleaning without extra parts or mechanisms. U.S. Pat. No. 3,214,102 issued to Meyer discloses, for example, a deformable nozzle that produces a concentrated stream of liquid, not an atomized spray. While some other industrial nozzles produce atomized sprays, most do so by utilizing rigid nozzles. U.S. Pat. No. 5,323,963 issued to Ballu discloses, for example, an elastically deformable nozzle having a discharge opening that is normally open wherein the geometry of the exit region is adjusted by a movable rigid retaining collar. Such a nozzle, however, is not fully self cleaning since the geometry is controlled by the rigid restraining collar.

Another sprayer designed for industrial use in spraying anti-coking substances is disclosed in USSR Inventor's Certificate SU 1729602 A1. This sprayer, for example, includes a nozzle made of an elastic material having spherical inner and outer surfaces and a slot-shaped exit orifice. The inner and outer spherical surfaces of the nozzle are concentric and the ratio of the diameter of the inner spherical surface of the nozzle to the square of the thickness of its wall is from 3.0 to 3.7. One problem with this type sprayer is that it produces streams of liquids and not an atomized spray. U.S. Pat. No. 3,286,931 issued to Webb, and U.S. Pat. No. 5,074,471 issued to Baumgarten et al., disclose, for example, normally closed, self cleaning orifices that are also designed to produce concentrated streams of liquid and not an atomized spray. Unfortunately, none of these aforementioned pump spray packages have provisions for quick shut off of the product stream, well defined atomized spray patterns, or allow for priming of manually actuated pumps.

Some other dispensing systems for consumer products utilize simple flexible diaphragms with center cut slits. Such an atomizer is disclosed in U.S. Pat. No. 3,428,223 issued to Lewiecki which specifies that it is for use with aerosol products. Such an atomizer has been tested using a manually actuated pump with a viscous vegetable oil. When tested in this manner, the Lewiecki atomizer resists clogging and closes when at rest, but the resulting spray pattern is poorly atomized and, as a result, the fluid product is poorly distributed on the target surface. Thus, a nozzle with a pump spray delivery system capable of dispersing a solids laden fluid into a fan shaped atomized spray pattern that also provides a balance between shutoff and priming is not disclosed in the art and would be very beneficial.

SUMMARY OF THE INVENTION

In one aspect of the present invention, a nozzle for a hand holdable spray delivery system used when dispensing fluids having solid particles suspended therein is provided. Preferably, the fluid dispensed is a vegetable oil based cooking oil that contains solid particles. The spray nozzle comprises a housing having an inlet side and an exit side. The housing has at least one conduit through the inlet side and at least one dome shaped tip at the exit side. The dome shaped tip has an external surface concentric with an internal surface and preferably, the dome shaped tip has a thickness from about 0.005 inches to about 0.04 inches between the external surface and the internal surface. The internal surface has an inner diameter which is about 0.02 inches to about 0.1 inches. The conduit terminates at the internal surface of the dome shaped tip. The dome shaped tip has a slit extending therethrough from the internal surface through the external surface such that the conduit is in fluid communication with the slit. The slit is normally maintained closed and the spray nozzle is made of an elastomeric material having a flexural modulus from about 1,000 psi to about 25,000 psi. The dome shaped tip can be a spherical segment or the internal surface and the external surface can be hemispherical. The spray nozzle can have a slit that is centrally located within the dome-shaped tip or the slit can be located at an off-set position relative to the dome-shaped tip. Preferably, the spray nozzle is formed as a single unitary piece and the elastomeric material is a thermoplastic copolyester. A vent passage can also be provided. The vent passage extends from outside atmosphere to the conduit allowing venting of the discharge passage with a minimal amount of fluid leakage. Alternatively the spray nozzle can include an elastomeric insert and a rigid endcap. The rigid endcap can be hollow and have open ends. The insert includes the conduit and the dome-shaped tip and the insert are situated within the rigid endcap such that the slit aligns with one of the open ends. The insert can have a top surface having the dome-shaped tip thereon, and a bottom surface opposite the top surface wherein at least one of the top surface and the bottom surface are concave.

In another aspect of the invention, a spray delivery system for dispensing a fluid is provided. The spray delivery system includes the spray nozzle attached to a manually actuated pump device. The manually actuated pump device includes an inlet passage, a pump chamber, and a discharge passage having a distal end. These are all connected in fluid communication. The conduit of the spray nozzle is attached in fluid communication to the distal end of the discharge passage such that upon actuation of the pump device the fluid is pumped through the inlet passage and into the pump chamber then through the discharge passage creating a hydraulic pressure. Preferably the hydraulic pressure is from about 120 psi to about 170 psi within the conduit. The hydraulic pressure causes the slit in the dome shaped tip to resiliently open forming an elongated opening through which the fluid is dispensed in a fan shaped atomized spray. A container for storing the fluid can also be provided. The manually actuated pump device is attached to the container such that the inlet passage is in fluid communication with the fluid in the container. Alternatively, the spray delivery system can have a spray nozzle which includes an elastomeric insert and a rigid endcap. The rigid endcap is hollow and has first and second open ends. The insert includes the conduit and the dome-shaped tip and the insert is situated within the rigid endcap such that the slit aligns with the first open end. The endcap is attached to the discharge passage of the manually actuated pump device by the second open end.

BRIEF DESCRIPTION OF THE DRAWINGS

While the specification concludes with claims which particularly point out and distinctly claim the invention, it is believed that the present invention will be better understood from the following description taken in conjunction with the appended claims and the accompanying drawings, in which like reference numerals identify identical elements and wherein;

DETAILED DESCRIPTION OF THE INVENTION

Figure 1:
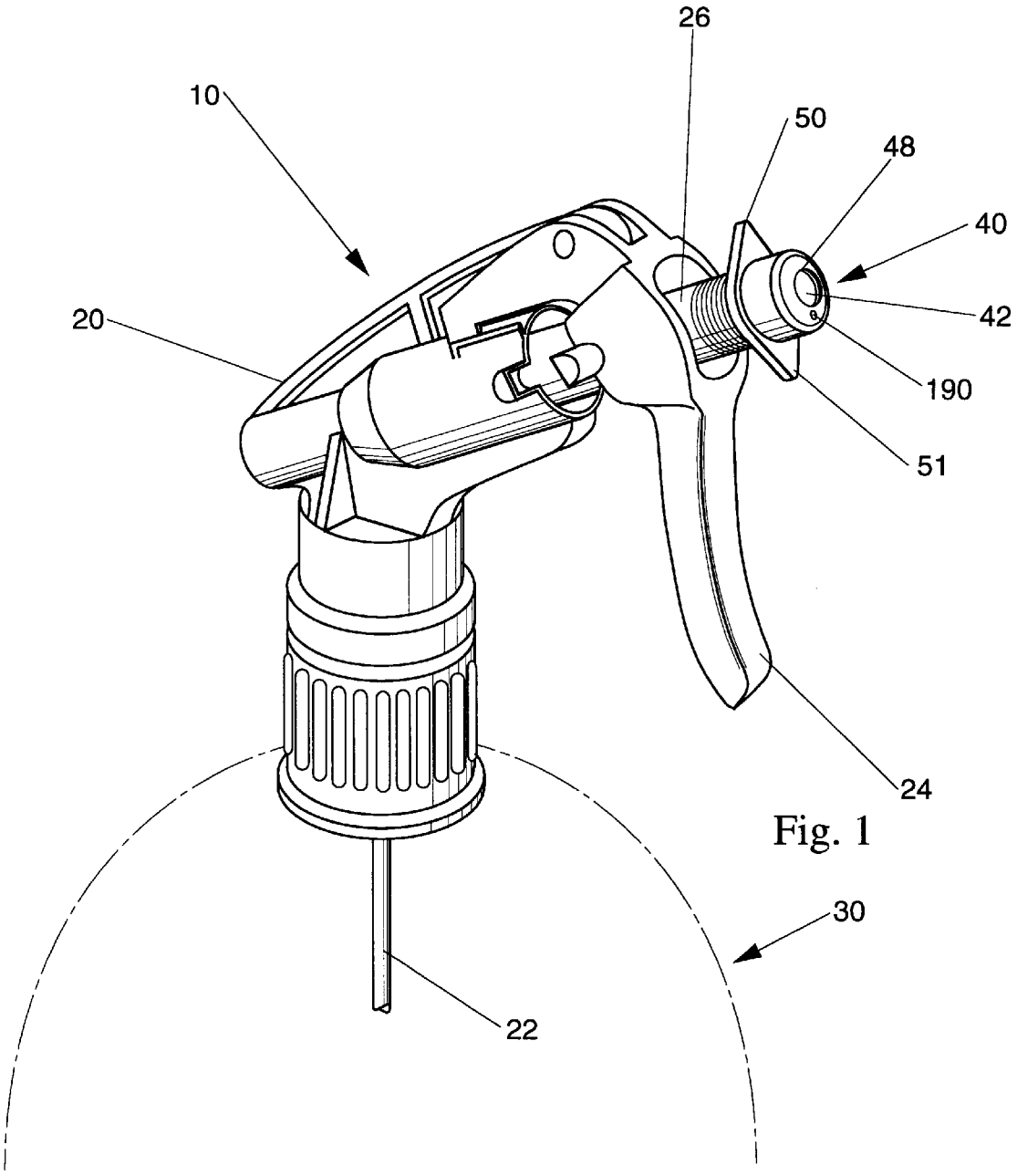
FIG. 1 is a perspective view of a spray delivery system according to the present invention, with the container shown via phantom line.

In a particularly preferred embodiment seen in FIG. 1, the present invention provides a hand holdable spray delivery system, indicated generally as 10, for dispensing a fluid. Spray delivery system 10 includes a spray nozzle 40, which is formed of an elastomeric material and has a dome-shaped tip 48, connected to a manually actuated pump device 20 and a container 30 (shown in outline only) for storing a fluid.

Figure 2:
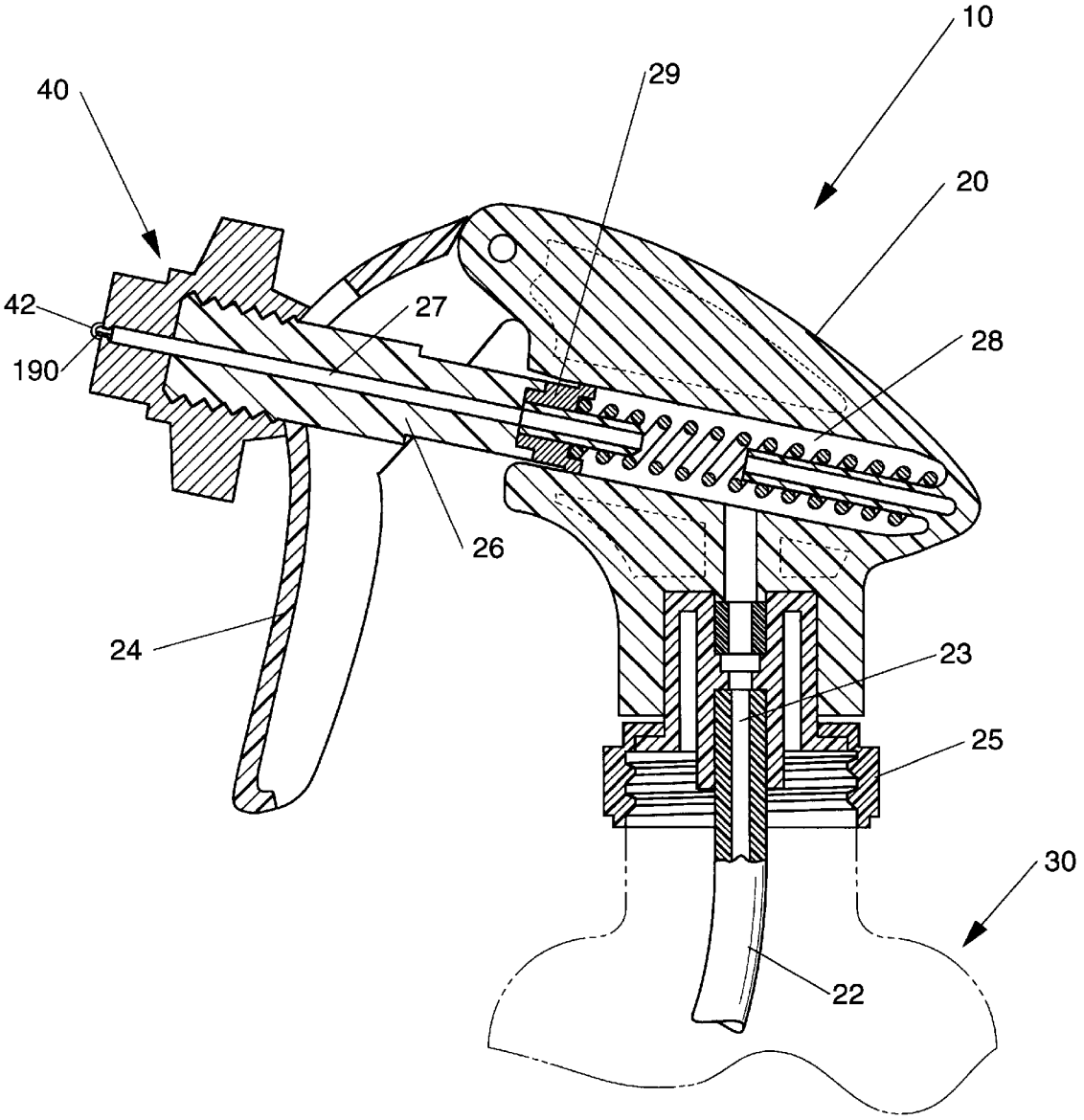
FIG. 2 is a partial cross section of the spray delivery system seen in FIG. 1, according to the present invention.

Referring to FIG. 2, an inlet tube 22 having an inlet passage 23 therethrough extends downward into container 30 from pump device 20. Elastomeric spray nozzle 40 is connected to a discharge tube 26 of pump device 20. Discharge tube 26 has a discharge passage 27 extending therethrough and discharge passage 27 has a distal end and a proximate end. The proximate end of discharge passage 27 is connected to a pump chamber 28. Spray nozzle 40 is attached in fluid communication to the distal end of discharge passage 27 such that the fluid passing through discharge passage 27 flows through spray nozzle 40 and is dispensed therefrom in a fan spray pattern.

Figure 10:
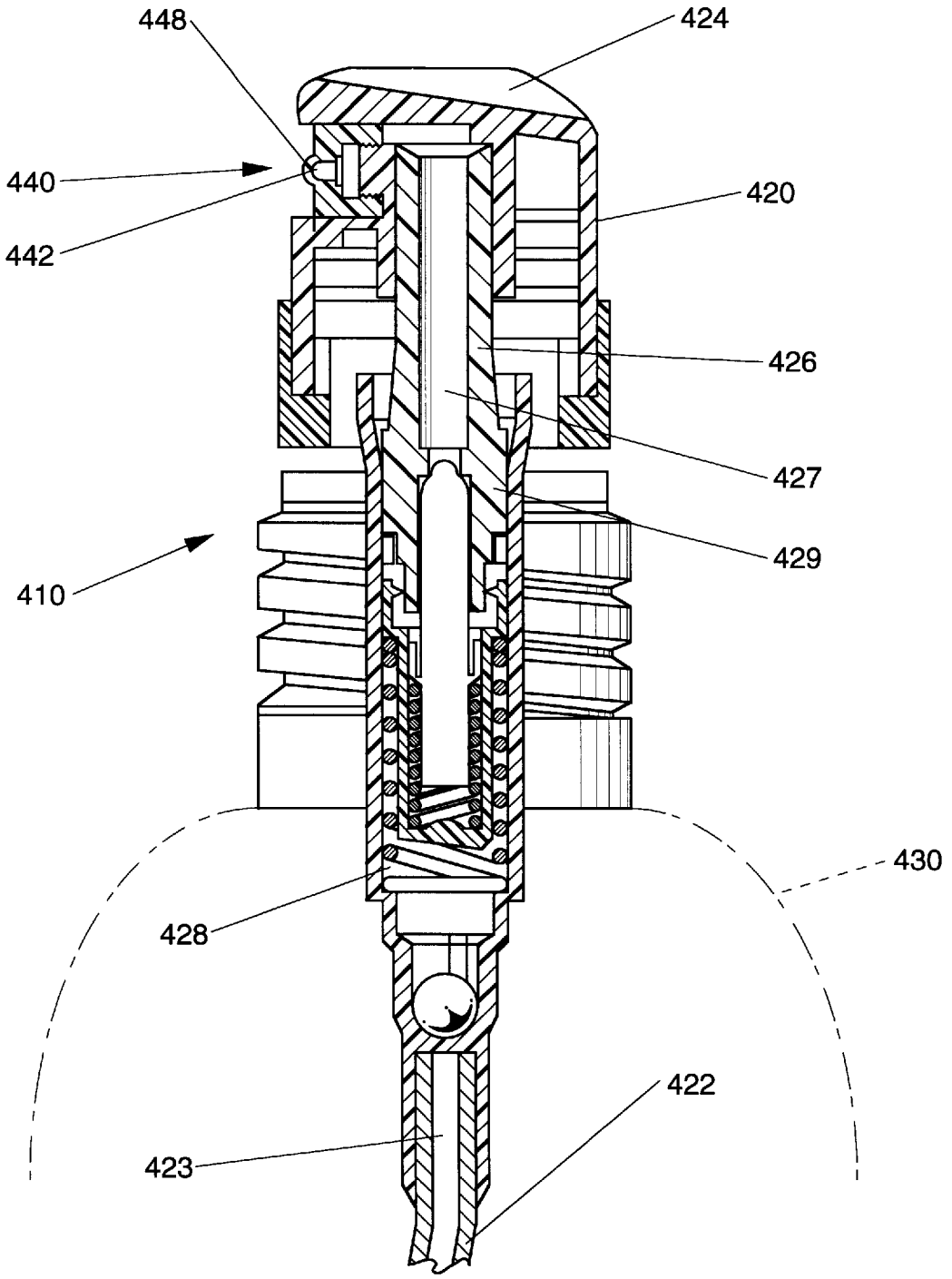
FIG. 10 is a partial cross-section similar to FIG. 2 of an alternative spray delivery system configuration according to the present invention.

A wide variety of manually actuated pump sprayer type mechanisms can be suitable for use in the present invention. A more detailed description of the features and components of such a typical pump device 20 may be found in U.S. Pat. No. 3,701,478 issued Oct. 31, 1972 to Tada, which is hereby incorporated herein by reference. Pump devices 20 of this general type are commercially available versions sold by Continental Manufacturing Co. under the trade name "922 Industrial Sprayer". While the above-mentioned pump device 20 may be presently preferred, many other standard manually actuated pump sprayer mechanisms could also function in this capacity. For example, a reciprocating finger pump type pump device 420 can also be used in this spray delivery system 410 as depicted in FIG. 10. In such a configuration, the finger button 424 replaces trigger 24, (seen in FIG. 1), as the actuator. Other elements depicted include an elastomeric spray nozzle 440 having a dome-shaped tip 448 with slit 442 incorporated into pump device 420, a container 430 (shown in outline only) for storing the fluid, a pump chamber 428, and a inlet tube 422 having an inlet passage 423 therein that extends downward within container 430 from pump chamber 428. In reciprocating finger pump type pump device 420 the elastomeric spray nozzle 440 is connected to finger button 424 so as to be in fluid communication with a discharge passage 427 of a discharge tube 426 and finger button 424 reciprocally engages a piston 429 that is slidably fitted within pump chamber 428 in order to effectuate actuation of spray delivery system 410. For typical operation of such a reciprocating type finger pump, see for example, U.S. Pat. No. 4,986,453 issued Jan. 22, 1991 to Lina et al. Alternatively, spray nozzle 40 of the present invention can be utilized in constant-pressure systems or various other systems that pressurize fluids, for dispensing such fluids in an atomized spray.

As seen in FIG. 2 pump device 20 is used to convey fluid from container 30, pressurize the fluid, and then pass this pressurized fluid through spray nozzle 40 via slit 42. In this presently preferred embodiment, a trigger 24 serves as an actuator that reciprocally engages a piston 29 that is slidably fitted within pump chamber 28 in order to effectuate actuation of spray delivery system 10. It is preferable for pump device 20 to dispense from about 1 cc to about 3 cc of fluid during each actuation or dispensing cycle. Manually actuated pump devices 20 used in the present invention have a transient hydraulic pressure dispensing cycle. This transient hydraulic pressure is generated during actuation since the pressure tends to gradually build up during the initial movement of trigger 24 by the operator's fingers upon applying the force to dispense. This pressure reaches a maximum during initiation of the dispensing cycle, somewhere during the travel of trigger 24 toward the end of the actuation stroke and thereafter rapidly decreases once the end of the actuation stroke is reached. The maximum hydraulic pressure preferably obtains a magnitude greater than about 90 psi; more preferably, the maximum hydraulic pressure can obtain a range from about 120 to about 170 psi; even more preferably, the maximum hydraulic pressure is from about 129 to about 157 psi; most preferably, the maximum hydraulic pressure is about 143 psi. The force required to dispense the fluid is the amount of force that the operator must exert on trigger 24 in order to actuate pump device 20. This force to dispense should be easy and non-fatiguing to the operator's fingers and hand. Preferably, the force to dispense is less than about 10 $lb_f$ an actuation rate of from about 3 in./s to about 6 in./s; and more preferably, the force to dispense is from about 5 $lb_f$ to about 8 $lb_f$.

Figure 3:
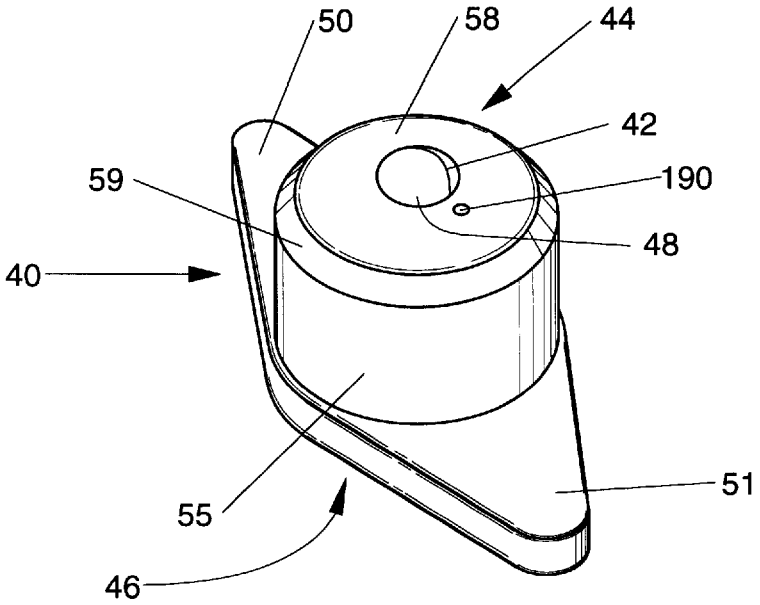
FIG. 3 is an enlarged perspective view of the spray nozzle of FIG. 1.

FIG. 3 shows a spray nozzle 40 formed as a single unitary piece with a dome-shaped tip 48 for use with spray delivery system 10. Spray nozzle 40 includes a housing 55, which is preferably cylindrical in shape, having an inlet side 46 and an exit side 44. Housing 55 has a nozzle face 58 with a chamfer 59 located on the perimeter of nozzle face 58 at exit side 44. On nozzle face 58 there is a domed-shaped tip or dome 48 that includes slit 42.

Figure 4:
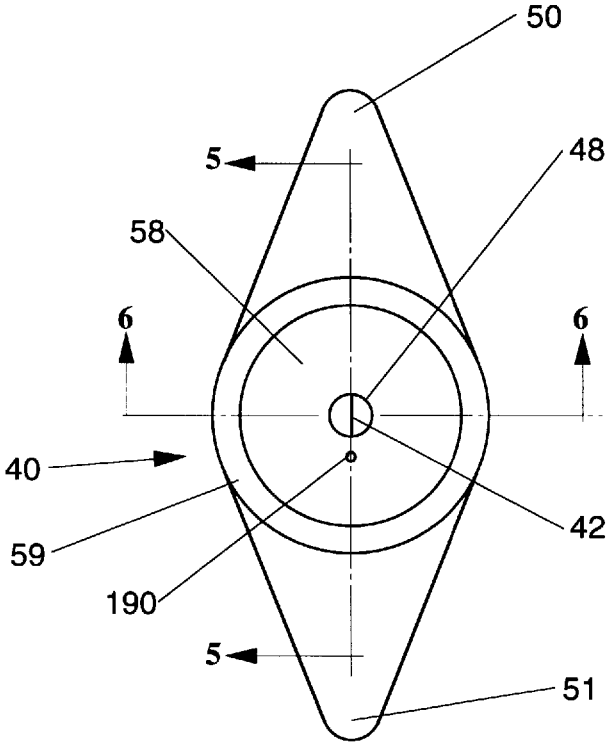
FIG. 4 is an enlarged plan view of the spray nozzle of FIG. 3.

In reference to FIG. 4, spray nozzle 40 is seen with dome 48 having slit 42 being centrally located in dome 48. Due to the asymmetry or elongated shape of the fan spray pattern produced when fluid is dispensed from spray delivery system 10, it is convenient to aid the operator by indicating the orientation of the fan spray pattern. This may be accomplished by optionally adding one or more visual or visual/functional features, such as the visual alignment tabs 50, 51 seen in FIG. 4 on spray nozzle 40. Visual alignment tabs 50 and 51 are preferably oriented such that they are aligned with slit 42 and thus, the fluid will be dispensed from spray nozzle 40 such that the fan spray pattern is delivered in a predictable orientation. Therefore the operator is able to easily and effectively apply a thin, uniform coating of fluid onto the target surface.

Figure 5:
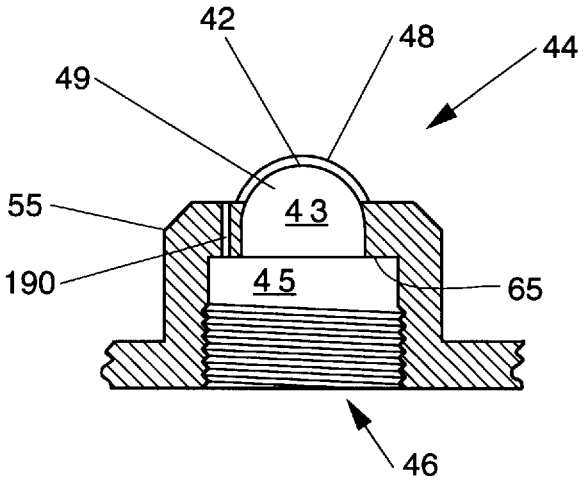
FIG. 5 is a cross section of the spray nozzle taken along line 5—5 of FIG. 4.
Figure 6:
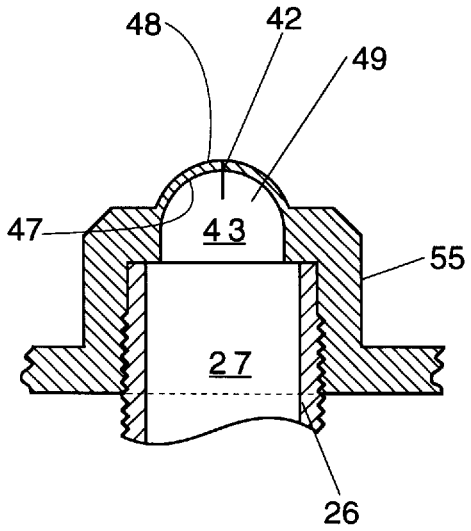
FIG. 6 is a cross section of the spray nozzle taken along line 6—6 of FIG. 4 and showing a portion of the discharge passage.

In reference to FIGS. 5 and 6, housing 55 has an internal recess 45 extending through inlet side 46 that terminates in slit 42 at exit side 44. Internal recess 45 includes a middle conduit 43 and an upstream conduit 49. Middle conduit 43 is preferably cylindrical and upstream conduit 49 preferably has a dome-shaped internal surface 47 therein at exit side 44. Dome 48 also has a dome-shaped external surface 63, which is preferably concentric with internal surface 47. Dome-shaped, as used herein, refers to resembling or being shaped substantially hemispherical or being in the form of a substantially spherical segment. A spherical segment can be either less or more than 50% of a sphere.

Internal surface 47 preferably has a diameter that is substantially equal to the diameter of middle conduit 43 and thus, preferably, middle conduit 43 and upstream conduit 49 have equivalent diameters. Preferably, the inner diameters of middle conduit 43 and upstream conduit 49 are from about 0.02 in. to about 0.1 in.; more preferably, from about 0.03 in. to about 0.06 in.; and most preferably, about 0.04 in. Dome 48 has a slit 42 extending therethrough from internal surface 47 through external surface 63 such that upstream conduit 49 and internal recess 45 are in fluid communication with slit 42. The space between internal surface 47 and external surface 63 is the thickness of dome 48. Slit 42 extends entirely through this thickness. The thickness of dome 48 is preferably from about 0.005 in. to about 0.04 in., and most preferably from about 0.01 in. to about 0.02 in.

In the event that the thickness of dome 48 is not uniform, the thickness ranges are referring to the area immediately surrounding the slit 42. Slit 42 is cut or formed into dome 48 and preferably, has a length substantially the same as the diameter of the dome 48. Alternatively, spray nozzle 40 can have a slit 42 that is only partially the length of the diameter of dome 48. Such a reduced length slit 42 can reduce the major axis of the fan shaped spray pattern generated when fluid is dispensed from spray nozzle 40.

The internal recess 45 of spray nozzle 40 is attached in fluid communication to a distal end of discharge passage 27 such that the fluid passing through discharge passage 27 flows through middle conduit 43, converges toward slit 42 as it flows through upstream conduit 49 and is dispensed therefrom in a fan spray pattern. Various methods of attaching spray nozzle 40 to discharge passage 27 of pump device 20 can be used, including for example, a snap-fit, threads, or the like. Internal recess 45 preferably, includes a shoulder 65 located between exit side 44 and inlet side 46. Discharge tube 26 abuts shoulder 65 when spray nozzle 40 is properly connected to pump device 20 such that slit 42 is in fluid communication with pump device 20. Optionally, multiple shoulders can be utilized to reduce the interior diameter of the internal recess 45 to that of middle conduit 43 in a step wise fashion. Internal recess 45 is used for conducting the fluid from discharge passage 27 to slit 42.

During a dispensing cycle of spray delivery system 10 it is the transition of internal recess 45 to dome-shaped internal surface 47 that causes the convergence of the fluid streamlines within the upstream conduit 49 toward slit 42 at high stream velocities when the fluid is forced through spray nozzle 40. Slit 42 is preferably normally maintained closed at rest and opens slightly when fluid flows through slit 42 forcing the fluid streamlines to form a flat liquid sheet oriented parallel to slit 42 when the fluid exits or is dispensed from the confines of spray nozzle 40. External to spray nozzle 40 the liquid sheet forms ligaments and thereafter droplets which disperse or disintegrate into a fan shaped atomized spray pattern. Generally, this fan spray pattern consists of dispersed droplets of fluid arranged such that a transverse cross section of the fan spray pattern would be elongated, elliptical, or oblong in shape. The dispersed droplets of fluid may be finely dispersed, such as an atomized spray, or even more coarsely dispersed representing larger droplets of fluid. Nonetheless, these dispersed droplets do not constitute a continuous or concentrated stream of fluid. When this fan spray pattern contacts the target surface, a thin and uniform coating of fluid is produced having an elongated shape.

Although slit 42 is normally maintained closed at rest, under dynamic conditions, when spray delivery system 10 is actuated, slit 42 opens slightly, resiliently deforming and generating an elongated three-dimensional ellipsoidal orifice. The fluid flowing through the ellipsoidal orifice under dynamic conditions generates the fan-type spray pattern. A precompression characteristic of spray nozzle 40 is believed to result from the threshold hydraulic pressure needed to open slit 42 enough to atomize the fluid during initiation of the actuation cycle. Similarly, a shut-off characteristic of spray nozzle 40 results during the ending part of the actuation cycle when the hydraulic pressure is reduced to a level lower than the threshold hydraulic pressure. The level of the threshold hydraulic pressure is believed to be a function of the resilient nature of the elastomeric material that dome 48 is made from, including tensile and flexural moduli, along with the dome 48 thickness and residual stresses due to processing. This precompression characteristic allows spray nozzle 40 to act as a shipping seal, since the threshold hydraulic pressure must be overcome before fluid can escape out of spray delivery system 10 through spray nozzle 40.

Furthermore, the ability of spray nozzle 40 to remain unclogged during dispensing of fluids, that have solid particulates suspended therein, is believed to be a result of the elastic and flexible nature of the elastomeric material that dome 48 is made from. In particular, a blockage of opened slit 42 by a solid particulate causes the hydraulic pressure behind slit 42 to increase and in turn to further deform slit 42 so that the solid particulate can flow through slit 42 during the same or a subsequent dispensing cycle. Thus, the elastomeric material allowing slit 42 to resiliently deform substantially reduces the likelihood of permanent clogging during use. This is known as the nozzle's self-cleaning characteristic. Blockage of slit 42 refers to either partial or total clogging. Partial clogging occurs when a solid particulate blocks a central or substantial part of the opened slit 42 thus deteriorating the atomized spray into one, two, or just a few streams of fluid coming out of the slit 42. On the other hand, total clogging occurs when a particulate completely blocks the opened slit 42 thus stopping the fluid flow. Similar behavior is produced when, instead of a single solid particulate, an agglomeration of smaller particulates, formed behind slit 42 due to either hydrodynamic or aging conditions, tries to flow through the opened slit 42. Slit 42, thus provides the spray nozzle 40 with precompression, shut-off, shipping seal and self-cleaning characteristics.

A small vent passage 190 can be incorporated into spray nozzle 40. Vent passage 190 is used to help vent the air during the priming stage of an actuation cycle. This vent passage 190 can be located in various locations such as immediately adjacent dome 48 or vent passage 190 can even be located along slit 42. Vent passage 190 forms a vent from the outside atmosphere of spray nozzle 40 into internal recess 45 and discharge passage 27. The size of vent passage 190 is of particular importance in the operation of spray nozzle 40 both in the priming phase and the spraying phase. Vent passage 190 should be of sufficient size to allow air to pass through easily, but it should be small enough so that only a minimal amount of fluid product leakage occurs during dispensing. The size of vent passage 190 in relation to this leakage is governed approximately by the following expression, when the fluid is a Newtonian fluid:

$$\Delta P \approx \frac{64 \cdot \mu \cdot L \cdot Q_{leak}}{\pi \cdot D^4}$$

where $\mu$ is the fluid viscosity, L is the length of vent passage 190, $Q_{leak}$ is the allowable leakage through vent passage 190, and D is the hydraulic diameter of vent passage 190. Preferably, $Q_{leak}$ is about 1% of the primary flow rate which is the flow rate of the fluid product being dispensed. With proper sizing and positioning of vent passage 190, the leakage will be unnoticeable by the user during actuation of the spray delivery system 10.

Figure 7:
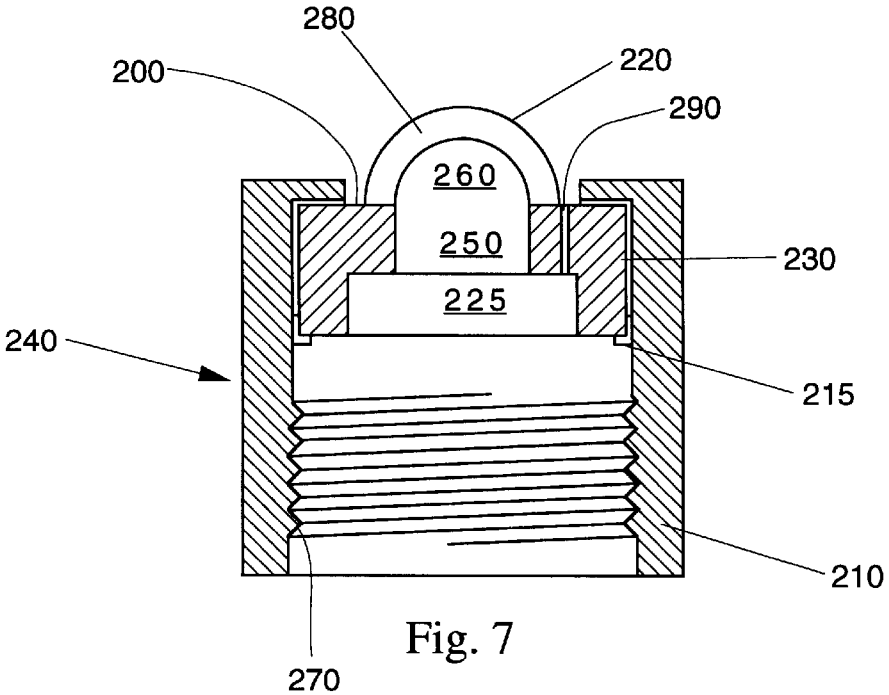
FIG. 7 is an enlarged cross section of an alternative embodiment of the spray nozzle having an insert with a dome-shaped tip positioned within an endcap.

In an alternative embodiment, spray nozzle 240 as shown in FIG. 7 includes an elastomeric insert 200 with a dome-shaped tip or dome 220 and an endcap 210 having threads 270 that mate with the threads on discharge tube 26. Endcap 210 can be made from a rigid plastic or metal. Spray nozzle 240 can thus be attached to the distal end of discharge tube 26 of spray delivery system 10. Elastomeric insert 200 is press fit into endcap 210 or can be held inside endcap 210 by a retaining ring 215. Elastomeric insert 200 includes dome 220 having a slit 280 and a base housing 230. Fluid flows through housing 230 towards dome 220 by passing through the base conduit 225, middle conduit 250, and upstream conduit 260. Middle conduit 250 preferably has a smaller diameter than base conduit 225, and upstream conduit 260 preferably has the same diameter as middle conduit 250 while being substantially hemispherical in shape. Air can be vented through a vent passage 290 which can alternatively be in the form of a side groove located at the periphery of housing 230 of insert 200, either aligned with the slit 280 or in various other locations along the periphery.

Figure 8:
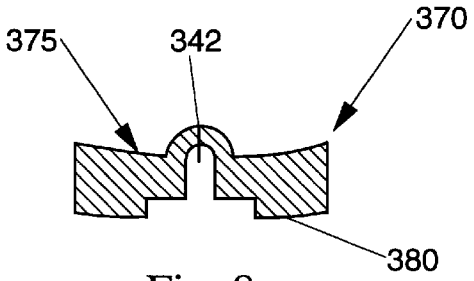
FIG. 8 is an enlarged cross section of an insert having concave top and bottom surfaces.

Another alternative embodiment nozzle insert 370 shown in FIG. 8 has a concave top surface 375 and a concave bottom surface 380. The concavity of both top and bottom surfaces 375, 380 forces a slit 342 to open slightly when nozzle insert 370 is fitted into the endcap 210 or even when bottom surface 380 is pressed against the distal end of discharge tube 26. The concavity of top surface 375 or bottom surface 380 can be arranged to allow the amount which slit 342 opens to be controlled by the user when threading endcap 210 onto discharge tube 26.

Figure 9:
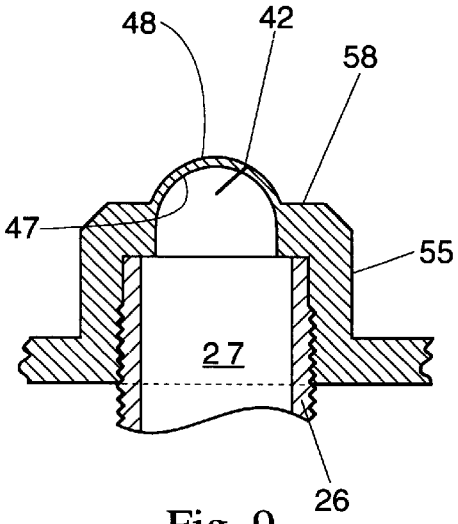
FIG. 9 is a cross section of a spray nozzle similar to FIG. 6, having a slit at an offset position.

Several additional configurations of spray nozzle 40 can embody the invention described herein. For example, upstream conduit 49 can be cylindrical in shape and extend from the middle conduit 43 to the dome 48 terminating at a flat internal surface 47 that has a slit 42 extending through dome 48 to a dome-shaped exterior surface 63. Middle conduit 43 can be followed by upstream conduit 49 that is not coaxial with middle conduit 43. Thus, upstream conduit 49 can change the direction of the fluid flow by being off-set or inclined from the axis of the internal recess 45. Additionally, dome 48 can have a slit 42 that is located at an off-set or off-center position relative to the axis of the dome 48 as illustrated in FIG. 9. This configuration can direct the fan spray pattern at an angle off-set from the axis of dome 48 or centerline of spray nozzle 40. Other embodiments can include, for example, slit 42 that is slightly open at rest, or even an external shape of dome 48 that is conical, frustoconical, pyramidal, or other shape, or an internal surface 47 that is conical, pyramidal or other shape which achieves fluid flow convergence toward the slit 42. Various additional embodiments can be made of combinations of configurations equivalent to those described herein or combinations of portions of such configurations, or the like.

While spray delivery system 10, pump device 20, elastomeric spray nozzle 40 and nozzle insert 100 according to the present invention may be fabricated or manufactured in any suitable fashion, a presently preferred method of forming spray nozzle 40 and nozzle insert 100 is by injection molding. Slit 42 or 180 can be produced by any slicing technique, for example, using a knife or a laser, in a post-processing step. Also, container 30 can be blow molded using any number of well known materials, for example, high-density polyethylene (HDPE), polyethylene terephthalate (PET), or the like.

Spray nozzle 40 and nozzle insert 100 are made from an elastomeric material (i.e., a rubber-like material). Elastomeric materials typically belong to one of the following categories: thermoplastic elastomers (TPEs), thermoset elastomers, ethylene/octene (or butene or hexene, etc.) copolymers, ethylene/vinyl acetate (EVA) copolymers, and blends of the above. Concise descriptions and examples of the categories of elastomeric materials follow.

TPEs arc defined by the ASTM D1556 standard as: "a family of rubber-like materials that, unlike conventional vulcanized rubber, can be processed and recycled as thermoplastic materials", and are classified into three major categories: 1) block copolymers; 2) rubber/thermoplastic blends; and 3) elastomeric alloys (EAs). More specifically, block copolymers are styrenic rubbers (e.g. Kraton® from Shell Chemical), copolyester (e.g. Hytrel® from Du Pont), polyurethanes (e.g. Texin® from Bayer), and polyamides (e.g. Pebax® from Atochem). Rubber/thermoplastic blends (also called elastomeric polyolefins—TEOs) are of blends of ethylene-propylene-diene-monomer (EPDM) rubber and polyolefin (e.g. Vistaflex® from Advanced Elastomer Systems, L.P.) and blends of nitrile rubber and PVC (e.g. Vynite® from Dexter). EAs comprise systems with dynamically vulcanized elastomers (EPDM, nitrile, natural, and butyl rubber) in the presence of a thermoplastic (primarily PP) with an example being Santoprene® from Advanced Elastomer Systems, L.P. More about TPEs can be found in the literature, for example: M. T. Payne, and C. P. Rader, "Thermoplastic Elastomers: A Rising Star" in *ELASTOMER TECHNOLOGY HANDBOOK,* N. P. Cheremisinoff, (ed.), CRC Press, Boca Raton, Fla. (1993); and Legge, N. R., et al., (eds.), *THERMOPLASTIC ELASTOMERS*, Hanser Pub., New York (1987).

As far as thermoset elastomers are concerned, typical examples are Silastic® silicone elastomers from Dow Corning, Viton® fluoroelastomers from Du Pont, and Buna rubbers from American Gasket and Rubber Co. Finally, examples from the ethylene copolymers are the resins Engage® from Dow (with octene; using metallocene technology) and Flexomer® from Union Carbide (with butene and/or hexene), and examples of EVA copolymers are the resins Ultrathene® from Quantum and ELVAX® from Du Pont.

Other classifications of the elastomeric materials are based on material properties rather than physical or chemical compositions. Some of the relevant material properties are hardness, Young's (tensile) and flexural moduli, and tensile and flexural strengths. Material hardness is measured according to ASTM D2240 or ISO 868 standards. Hardness scales Shore A and Shore D are the most frequently used for elastomeric materials, with scale Shore D denoting harder materials. The ASTM (ISO) standards for the other tests are: tensile: D412 (37) or D638 (R527); and flexural: D790 (178). The chemical and physical compositions of an elastomeric material as well as its material properties need to be considered in selecting a nozzle material especially when the fluid to be dispensed attacks the material (e.g. dissolves it or strongly absorbs into it) or is attacked (e.g. contaminating the fluid due to extraction of material components from the elastomer) by it. If there is no Significant interaction between material and fluid then the material properties alone need to be considered in selecting the proper nozzle material.

The hardness of the elastomeric material that spray nozzle 40 or nozzle insert 100 are made from is preferably between about 40 Shore A and about 60 Shore D, more preferably between about 65 Shore A and about 50 Shore D, and most preferably between about 80 Shore A and 40 Shore D. The flexural modulus of the nozzle material is preferably between about 1,000 psi (6.9 MPa) and about 25,000 psi (172.4 MPa), more preferably between about 2,000 psi (13.8 MPa) and about 15,000 psi (103.4 MPa), and most preferably between about 3,000 psi (20.7 MPa) and about 9,000 psi (62.9 MPa).

Spray delivery system 10 of the present invention may be used to disperse virtually any fluid product in a more controlled and more consistent fashion. However, it has been found to be particularly advantageous to use such a spray delivery system 10 for dispersing viscous fluids having solid particulates suspended therein. Such fluids contain a substantial mass or volume fraction of particulates. Examples of such fluids include, for example, cooking oils, pan coatings, flavor oils, mouthwashes, dyes, hair sprays, lubricating oils, liquid soaps, cleaning solutions, cosmetics, laundry detergents, dishwashing detergents, pre-treaters, hard surface cleaners, paints, polishes, window cleaners, rust preventatives, surface coatings, and the like.

Preferably, the particulates contained in these fluids have a maximum dimension equal to or less than the diameter of upstream conduit 49 leading to dome 48 and slit 42. A preferred liquid for use in this spray delivery system 10 is a vegetable oil based cooking oil formulated with a large percentage of vegetable oil. Such large percentage being from about 80% to about 100% by weight. Typically, these cooking oils include minor percentages of lecithin, emulsifiers and flavor enhancers along with other ingredients and solids, including for example, flavor solids, salts, or other solid particulate material used to enhance the cooking oil's performance For example see, U.S. Pat. No. 4,385,076, issued May 24, 1983 to Crosby, and U.S. Pat. No. 4,384,008, issued May 17, 1983 to Millisor. A particularly preferred cooking oil which has performed well with the spray delivery system 10 of the present invention comprises vegetable oil, lecithin, solid butter-flavored particles (about 0.13% w/w), carotene, other liquid flavors and salt particles (about 2% w/w) ; wherein from about 95% to about 100% of the solid flavor particles have a particle size less than 425 $\mu$m (US. 40 mesh); from about 15% to about 40% of these particles have a particle size greater than 75 $\mu$m (US. 200 mesh); from about 30% to about 50% have a particle size greater than 53 $\mu$m (US. 270 mesh); and from about 35% to about 60% have a particle size less than 38 $\mu$m (US. 400 mesh); and wherein 99.9% of the salt particles, in the unagglomerated state, have a particle size less than 25 $\mu$m and the weighted average particle size is less than 10 $\mu$m. As used herein the term particle size refers to the over-all width or diameter of the particle.

One combination which causes an interaction between fluid and material is cooking oil and either styrenic rubbers, or EAs and or TEOs. These elastomers contain plasticizers that can be extracted into the cooking oil thus contaminating it. Therefore, these materials do not comply with the appropriate US FDA regulation CFR Title 21, Section 177.2600 (i.e., for "rubber articles intended for repeated use") are not recommended for use in nozzles for atomizing cooking oils. Examples of other pertinent US FDA regulations are: CFR Title 21, Section 177.1210 for "closures with sealing gaskets for food containers"; 177.1350 for "ethylene/vinyl acetate copolymers"; 177.1520 for "olefin polymers"; 177.1590 for "polyester elastomers"; and 177.1810 for "styrene block copolymers". When using a vegetable-based cooking oil with suspended solid butter-flavored and salt particles, the only thermoplastic elastomers that can be properly used without the need to run the extraction tests specified in the FDA regulation CFR Title 21, Section 177.2600 are copolyesters, such as Hytrel® 3078 which has a flexural modulus of 4,000 psi at 73° F.

EXAMPLE DESCRIPTION

An example of a spray delivery system 10 according to the present invention includes a "922 Industrial Sprayer" manually actuated pump fitted with a nozzle comprising an insert made from Hytrel 3078 elastomeric material and having a dome-shaped tip and a polypropylene endcap. The nozzle having a dome with a thickness being about 0.017 in. and an internal diameter being about 0.04 in. was subjected to a test of 10,000 actuation cycles at an actuation speed of about 5 in./s. The fluid used was the above-identified particularly preferred cooking oil. This arrangement exhibited a clogging incident every 2,000 actuations; however these clogging incidents cleared during the immediately subsequent actuation cycles (i.e., less than 15 subsequent actuation cycles).

By way of comparison, an example using the same pump sprayer of the present invention was fitted with a typical rigid fan spray type nozzle having an elliptical orifice with a minor axis of about 250 $\mu$m and major axis of about 900 $\mu$m. This arrangement exhibited clogging incidents in as early as 150 actuation cycles when subjected to the same test as that described above. Many of the clogging incidents did not clear immediately after, but rather required a large number (i.e., 100 or more) of subsequent dispensing strokes to clear.

Although particular versions and embodiments of the present invention have been shown and described, various modifications may be made to the spray delivery system 10 and the methods of assembly or operation thereof without departing from the teachings of the present invention. The terms used in describing the invention are used in their descriptive sense and not as terms of limitation, it being intended that all equivalents thereof be included within the scope of the appended claims.

What is claimed is:

1. A spray nozzle comprising a housing having an inlet side and an exit side, said housing having at least one conduit through said inlet side and at least one dome shaped tip at said exit side, said dome shaped tip having an external surface concentric with an internal surface and said dome shaped tip having a thickness from about 0.005 inches to about 0.04 inches between said external surface and said internal surface, said internal surface having an inner diameter, said inner diameter being about 0.02 inches to about 0.1 inches, said conduit terminates at said internal surface of said dome shaped tip, said dome shaped tip having a slit extending therethrough from said internal surface through said external surface such that said conduit is in fluid communication with said slit, said slit being normally maintained closed, said spray nozzle being made of an elastomeric material having a flexural modulus from about 1,000 psi to about 25,000 psi, and a vent passage incorporated into said spray nozzle, said vent passage extending from outside atmosphere to said conduit.

2. The spray nozzle of claim 1 wherein said dome shaped tip is a spherical segment.

3. The spray nozzle of claim 1 wherein said internal surface and said external surface are hemispherical.

4. The spray nozzle of claim 1 wherein said slit is centrally located within said dome-shaped tip.

5. The spray nozzle of claim 1 wherein said spray nozzle is formed as a single unitary piece.

6. The spray nozzle of claim 1 wherein said slit is located at an off-set position relative to said dome-shaped tip.

7. The spray nozzle of claim 1 wherein said elastomeric material is a thermoplastic copolyester.

8. The spray nozzle of claim 1 wherein said spray nozzle further comprises an elastomeric insert and a rigid endcap, said rigid endcap being hollow and having open ends, said insert includes said conduit and said dome-shaped tip, said insert being situated within said rigid endcap such that said slit aligns with one of said open ends.

9. A spray delivery system for dispensing a fluid, said spray delivery system comprising:

(a) a spray nozzle comprising a housing having an inlet side and an exit side, said housing having at least one conduit through said inlet side and at least one dome shaped tip at said exit side, said dome shaped tip having an external surface concentric with an internal surface and said dome shaped tip having a thickness from about 0.005 inches to about 0.04 inches between said external surface and said internal surface, said internal surface having an inner diameter, said inner diameter being about 0.02 inches to about 0.1 inches, said conduit terminates at said internal surface of said dome shaped tip, said dome shaped tip having a slit extending therethrough from said internal surface through said external surface such that said conduit is in fluid communication with said slit, said slit being normally maintained closed, said spray nozzle being made of an elastomeric material having a flexural modulus from about 1,000 psi to about 25,000 psi; and, (b) a manually actuated pump device including an inlet passage, a pump chamber, and a discharge passage having a distal end, all being connected in fluid communication, said conduit of said spray nozzle being attached in fluid communication to said distal end of said discharge passage such that upon actuation of said pump device said fluid is pumped through said inlet passage and into said pump chamber then through said discharge passage creating a hydraulic pressure from about 120 psi to about 170 psi within said conduit, said hydraulic pressure causing said slit in said dome shaped tip to resiliently open forming an elongated opening through which said fluid is dispensed in a fan shaped atomized spray.

10. The spray delivery system of claim 9 wherein said spray nozzle further comprises an elastomeric insert and a rigid endcap, said rigid endcap being hollow and having first and second open ends, said insert includes said conduit and said dome-shaped tip, said insert being situated within said rigid endcap such that said slit aligns with said first open end, and said endcap being attached to said discharge passage by said second open end.

11. The spray delivery system of claim 9 wherein said fluid includes solid particulates suspended therein.

12. The spray delivery system of claim 11 wherein said fluid further includes a vegetable oil.

13. The spray delivery system of claim 9 further comprising a container for storing said fluid, said manually actuated pump device being attached to said container such that said inlet passage is in fluid communication with said fluid stored in said container.

* * * * *